US006425636B2

(12) United States Patent
Chen

(10) Patent No.: US 6,425,636 B2
(45) Date of Patent: Jul. 30, 2002

(54) ARMREST WITH A PUSH BUTTON FOR CONTROLLING LEVEL OF A CHAIR SEAT

(76) Inventor: Su-Jan Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/788,454

(22) Filed: Feb. 21, 2001

Related U.S. Application Data

(63) Continuation-in-part of application No. 09/612,974, filed on Jul. 10, 2000, now abandoned.

(51) Int. Cl.[7] ..... A47C 1/06
(52) U.S. Cl. ..... 297/344.19; 297/411.2
(58) Field of Search ..... 297/344.12, 344.19, 297/344.18, 411.2

(56) References Cited

U.S. PATENT DOCUMENTS 3,368,845 A * 2/1968 Watanabe
4,545,616 A * 10/1985 Booth
4,884,841 A * 12/1989 Holley
4,934,723 A * 6/1990 Dysarz
5,090,770 A * 2/1992 Heinrichs et al.
5,577,804 A * 11/1996 Tedesco

* cited by examiner

*Primary Examiner*—Milton Nelson, Jr.
(74) *Attorney, Agent, or Firm*—Rosenberg, Klein & Lee

(57) ABSTRACT

A chair includes a seat, a level-adjusting device mounted under the seat and including a support rod for supporting the seat, and an armrest attached to the seat. The armrest includes a push button and a cable has a first end operably connected to the push button and a second end operably connected to the support rod, whereby the support rod is actuated when the push button is pushed. An elastic element is provided for returning the button to its initial position.

14 Claims, 6 Drawing Sheets

ARMREST WITH A PUSH BUTTON FOR CONTROLLING LEVEL OF A CHAIR SEAT

CROSS REFERENCE TO RELATED APPLICATION

This is a continuation-in-part application of U.S. patent application Ser. No. 09/612,974 filed on Jul. 10, 2000, which is now abandoned.

BACKGROUND OF THE INVENTION

1. Field of the Invention

The present invention relates to an armrest with a push button for controlling level of a chair seat.

2. Description of the Related Art

FIG. 6 of the drawings illustrates a conventional chair equipped with a level-adjusting means for adjusting the level of the seat by an operative rod 99. However, the user must bend down in order to operate the operative rod 99. In addition, the protruding operative rod 99 adversely affects the overall aesthetically pleasing effect.

SUMMARY OF THE INVENTION

It is the primary object of the present invention to provide an armrest with a push button for controlling level of a chair seatwhile maintaining the overall aesthetically pleasing effect.

A chair in accordance with the present invention comprises:

- a seat;
- a level-adjusting means mounted under the seat and including a support rod for supporting the seat;
- an armrest attached to the seat, the armrest including a mounting seat securely attached to the seat;
- a rocker pivotally mounted to the armrest and including a first arm and a second arm;
- a push button operably connected to the first arm of the rocker; and
- a cable having a first end fixed to the second end of the rocker and a second end operably connected to the support rod, whereby the support rod is actuated when the push button is pushed, thereby controlling a level of the seat.

The mounting seat includes a mounting plate projecting from an inner side thereof for securely engaging with the seat. The mounting seat further includes an outer side having a compartment defined therein, the rocker being fixed to a bottom, wall defining the compartment. The bottom wall includes two engaging members and the rocker includes two pegs respectively formed on two lateral sides thereof for pivotally engaging with the engaging members, respectively. A cover is provided for covering the compartment of the mounting seat. The cover includes a cylinder with a screw hole and the mounting seat includes a stepped hole. A screw is extended through the stepped hole and the screw hole of the cylinder to thereby secure the cover to the mounting seat. The cover further includes an engaging plate. A peripheral wall defining the compartment of the mounting seat includes an engaging groove for receiving the engaging plate. The engaging plate of the cover includes a screw hole. A through-hole extends through the peripheral wall defining the compartment and a bottom wall defining the engaging groove. A further screw is extended through the through-hole and engaged with the screw hole of the engaging plate. The cover includes a slot and the push button includes an actuating piece that is extended through the slot of the cover and connected with the first arm of the rocker. The cover includes two holes and the push button includes two legs extending through the holes of the cover, respectively. Each leg includes a hooked portion for preventing disengagement of the push button from the cover.

The rocker includes a protrusion. A torsion spring is mounted around one of the pegs and has a first end attached to the protrusion and a second end attached to the bottom wall of the mounting seat for returning the rocker to its original position.; An elastic element is attached between the cover and the push button for returning the push button to its original position. The rocker further comprises a central slot and a stub formfeed between two lateral sides defining the central slot. A fixing plate has a first end fixed to the bottom wall of the mounting seat, the fixing plate further having a hooked second end engaged with the stub. The second arm of the rocker includes an engaging portion having a screw hole and a channel. The first end of the cable is extended through the channel. A bolt is extended through the screw hole and presses against the first end of the cable, thereby securing the first end of the cable to the rocker.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
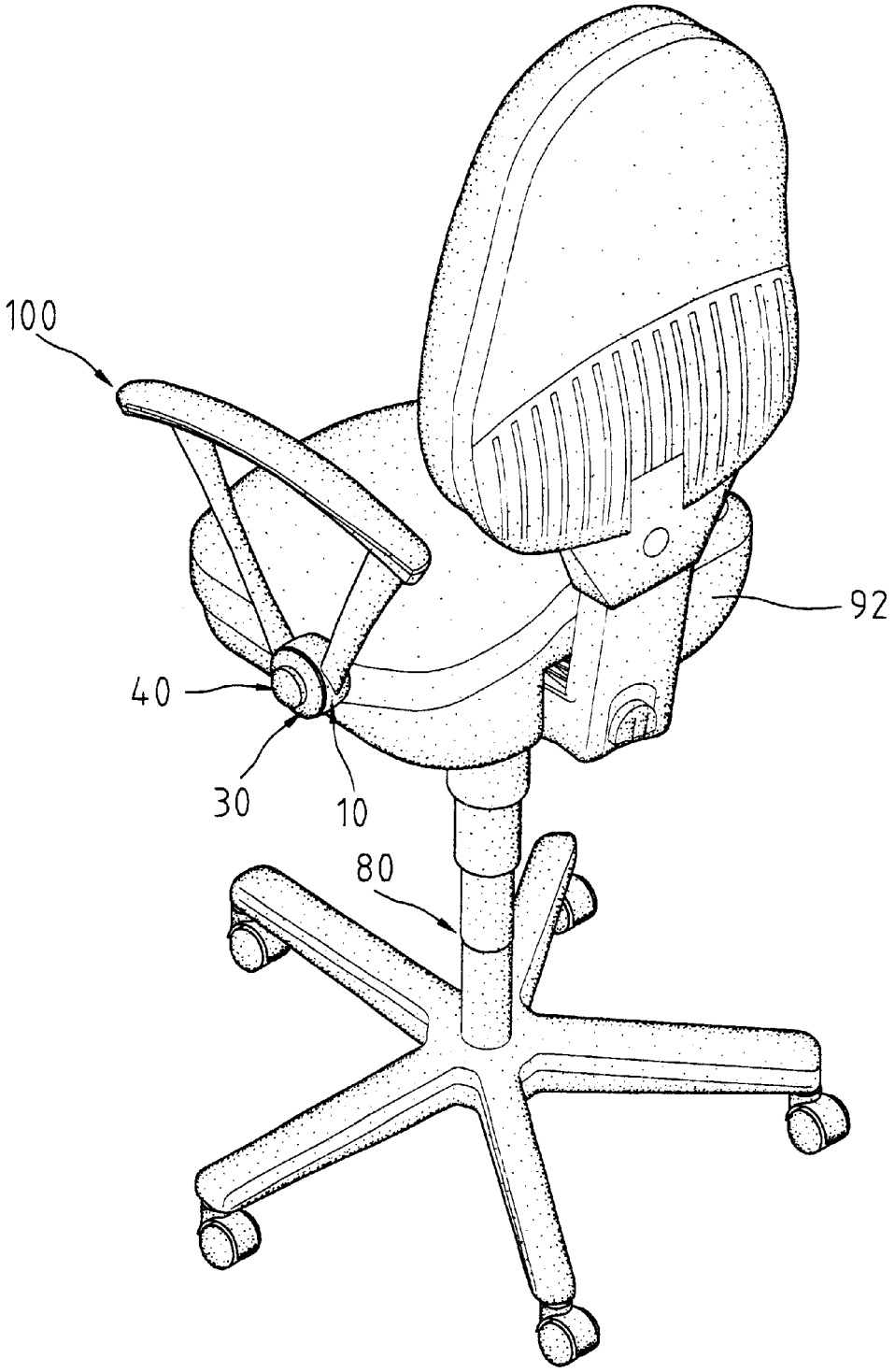
FIG. 1 is a perspective view of a chair with an armrest in accordance with the present invention.
Figure 2:
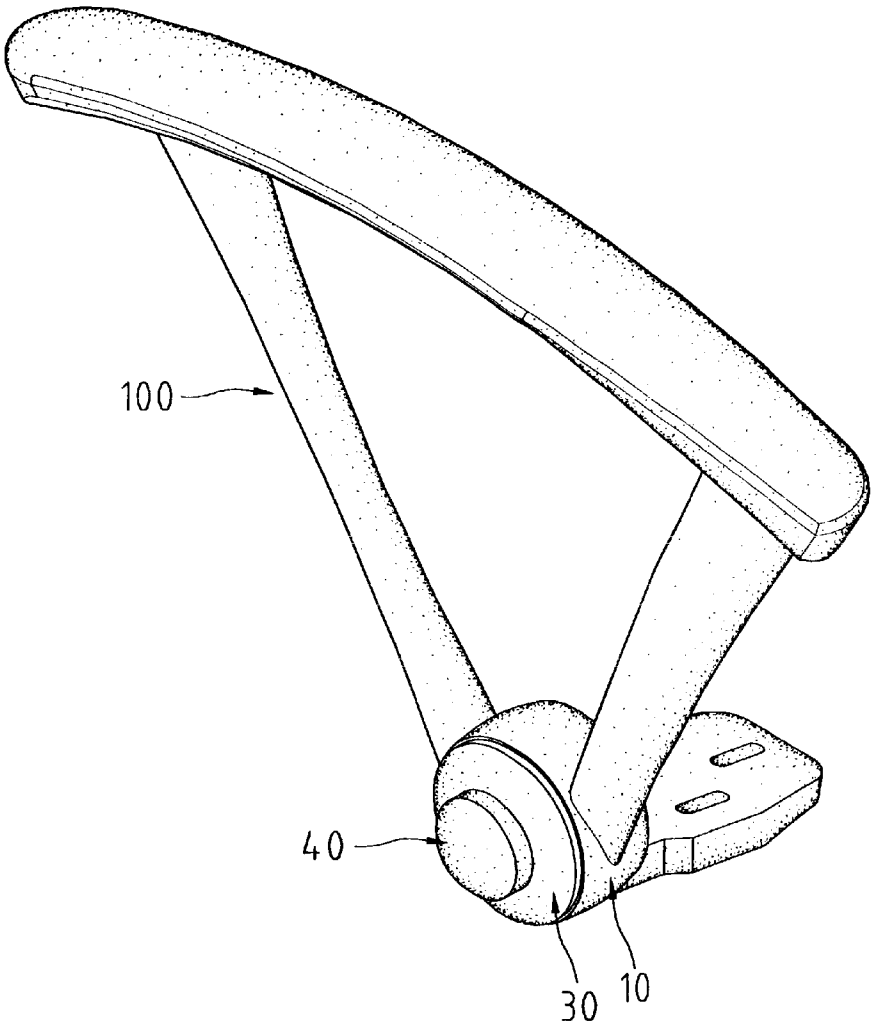
FIG. 2 is a perspective view of the armrest in accordance with the present invention.
Figure 3:
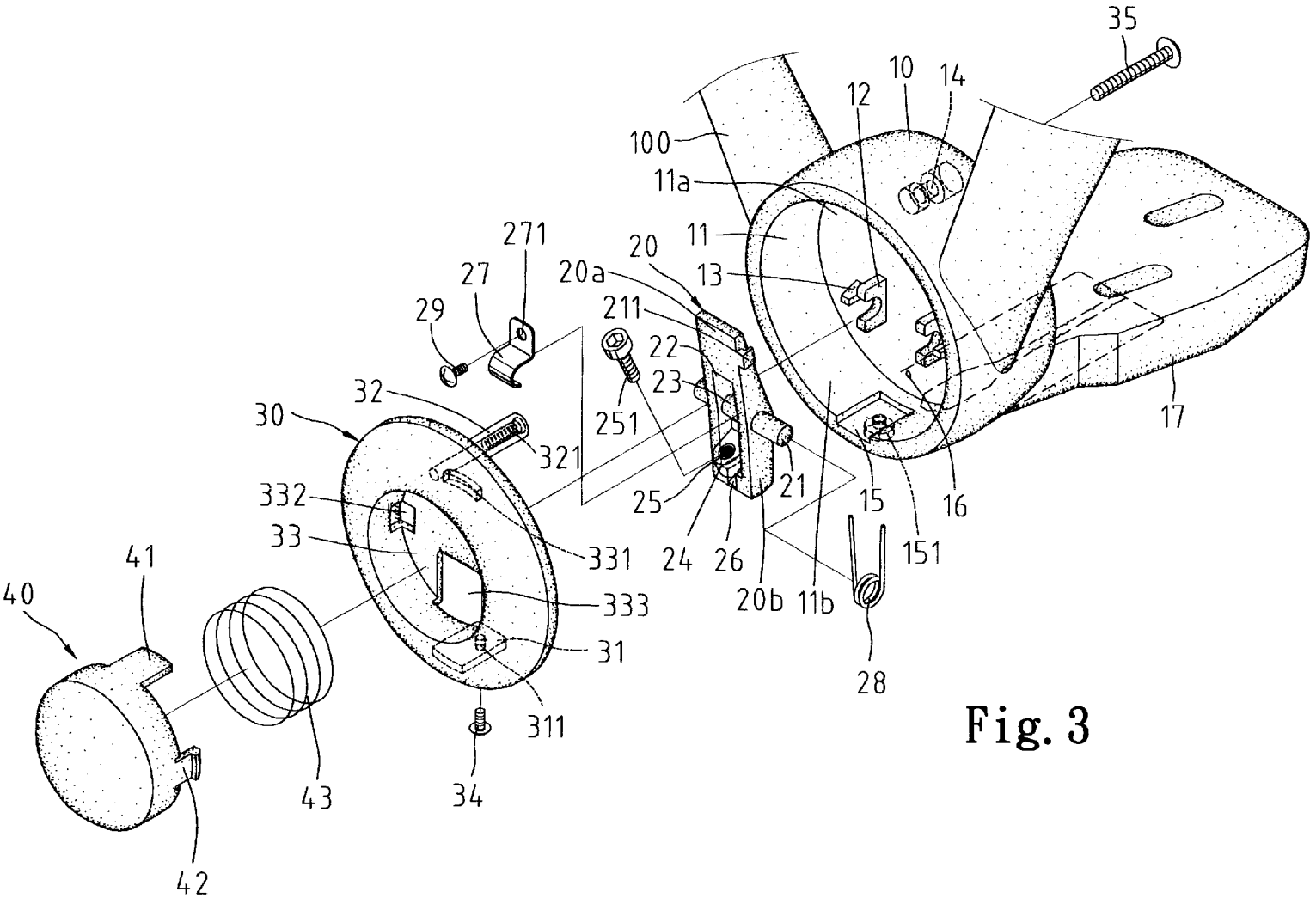
FIG. 3 is an exploded perspective view of the armrest in accordance with the present invention.

Referring to FIGS. 1 through 4, an armrest 100 in accordance with the present invention generally includes a mounting seat 10 comprising a compartment 11 in an outer side thereof. A mounting plate 17 projects from an inner side of the mounting seat 10 for securely engaging with a chair seat 92 (FIG. 1), which, in turn, has a level-adjusting means 80 mounted to an underside thereof. A bottom wall 11*a* defining the compartment 11 has two engaging members 12 provided thereon and a through-hole 16 defined therein. Two positioning blocks 13 are mounted on the bottom wall 11*a* and adjacent to the engaging members 12. An inner peripheral wall 11*b* defining the compartment 11 includes an engaging groove 15 defined therein, and a through-hole 151 extends through the inner peripheral wall 11*b* and a bottom wall (not labeled) defining the engaging groove 15.

A rocker 20 includes two pegs 21 that are respectively engaged with the engaging members 12 so as to be pivoted between the engaging members 12. Each peg 21 is retained in place by an associated positioning block 13. The rocker 20 includes a central slot 22 and a transverse stub 23 extends between two lateral walls defining the central slot 22. Preferably, the transverse stub 23 has a longitudinal axis coincident with the longitudinal axes of the pegs 21. A fixing plate 27 is used to secure the rocker 20 to the bottom wall 11*a* of the mounting seat 10. An end of the fixing plate 27 is fixed to the bottom wall 11*a* by a screw 29 and the other hooked end of the fixing plate 27 is engaged with the stub 23 of the rocker 20. The rocker 20 further comprises a first arm 20*a* and a second arm 20*b*. The second arm 20*b* comprises an engaging portion 24 including a screw hole 25 and a channel 26 communicated with the screw hole 25. In addition, a protrusion 211 is formed on a lateral side of the rocker 20. An elastic element, e.g., a torsion spring 28 is mounted around on of the pegs 21 and includes a first end attached to the bottom wall 11*a* of the mounting seat 10 and a second end attached to the protrusion 211 of the rocker 20.

Figure 4:
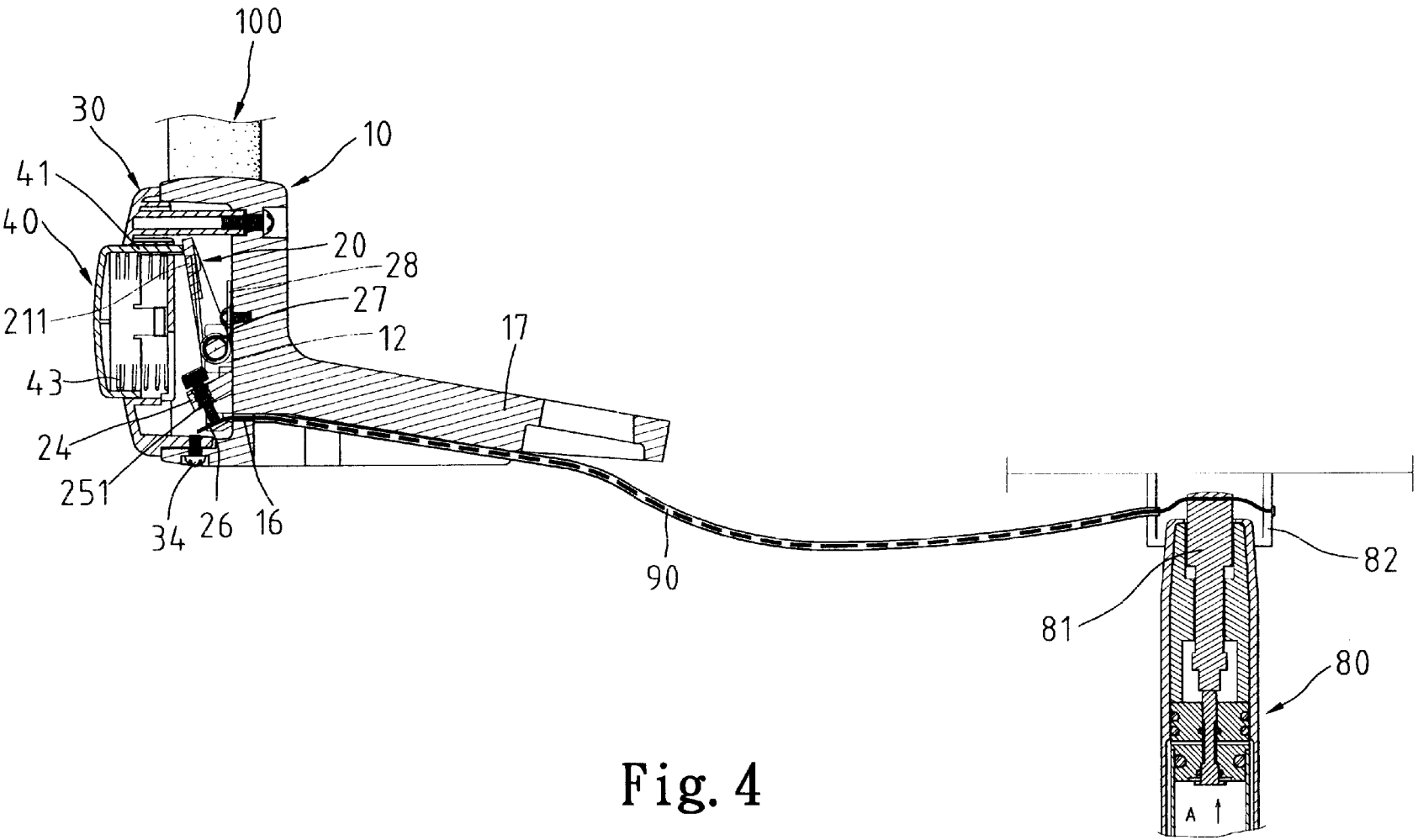
FIG. 4 is a schematic sectional view of the armrest and a level-adjusting means for the chair seat.

A cover 30 includes an engaging plate 31 projecting outward therefrom for engaging with the engaging groove 15 of the mounting seat 10. As illustrated in FIG. 4, a screw 34 is extended through the through-hole 16 of the mounting seat 10 and a screw hole 311 in the engaging plate 31. The cover 30 further includes a cylinder 32 projecting outward therefrom and including a screw hole 321. A screw 35 is extended through a stepped hole 14 in the mounting seat 10 and the screw hole 321 of the cylinder 32, thereby securing the cover 30 to the mounting seat 10. Thus, the compartment 11 of the mounting seat 10 is covered by the cover 30. The cover 30 further includes two holes 332 and an opening 333, which will be described later.

A push button 40 includes two legs 42 that are respectively extended through the holes 332 of the cover 30. The push button 40 further includes an actuating piece 41 that is extended through a slot 331 in the cover 30 to operably connect with the first arm 20*a* of the rocker 20. Thus, the push button 40 is movable with respect to the cover 30. An elastic element, such as a spring 43, is attached between the cover 30 and the push button 40 for returning the push button 40 to its original position. Each leg 42 of the push button 40 has a hooked portion (not labeled) to prevent disengagement of the push button 40 from the cover 30.

Figure 5:
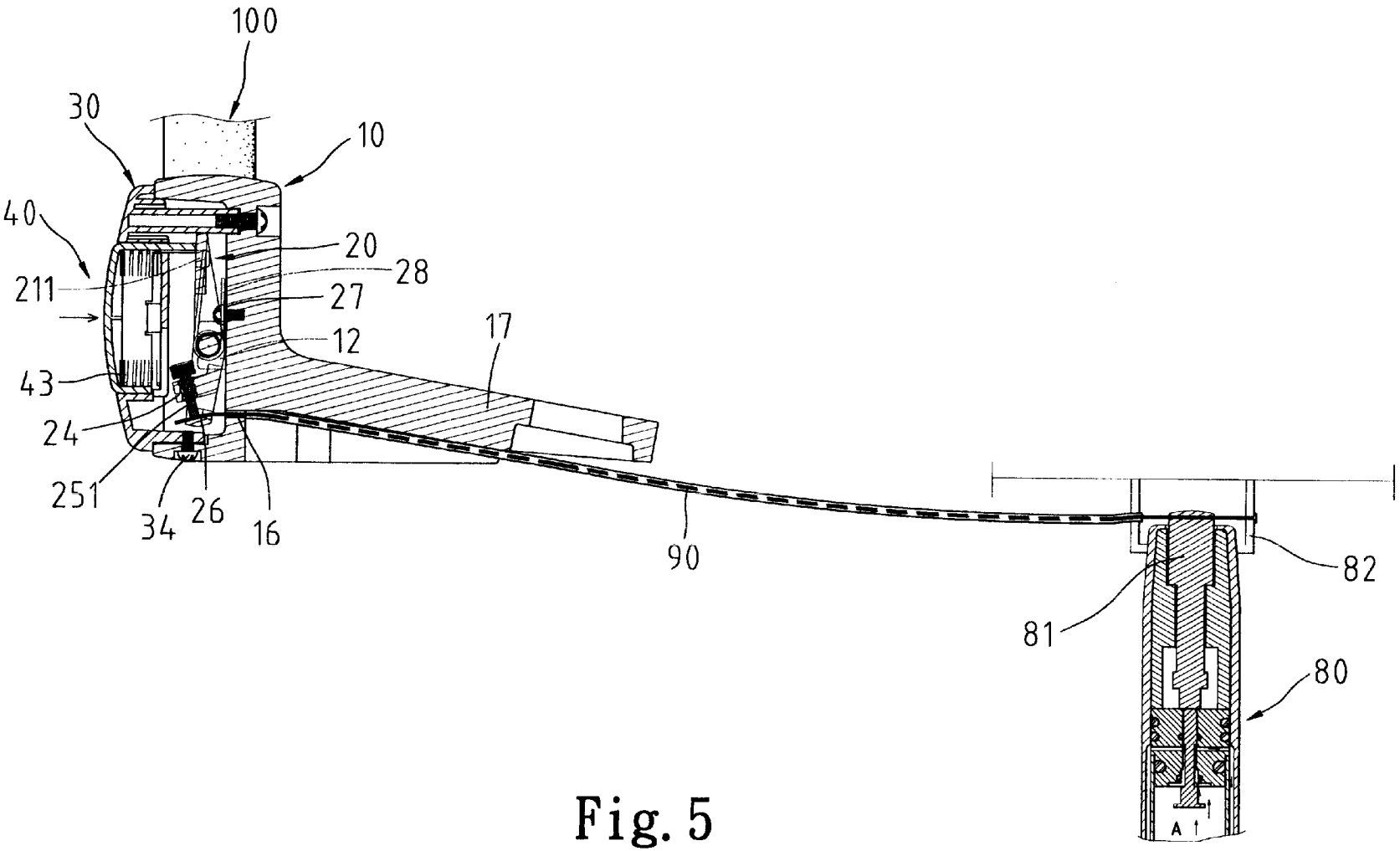
FIG. 5 is a sectional view similar to FIG. 4, illustrating operation of the level-adjusting means by a push button on the armrest.
Figure 6:
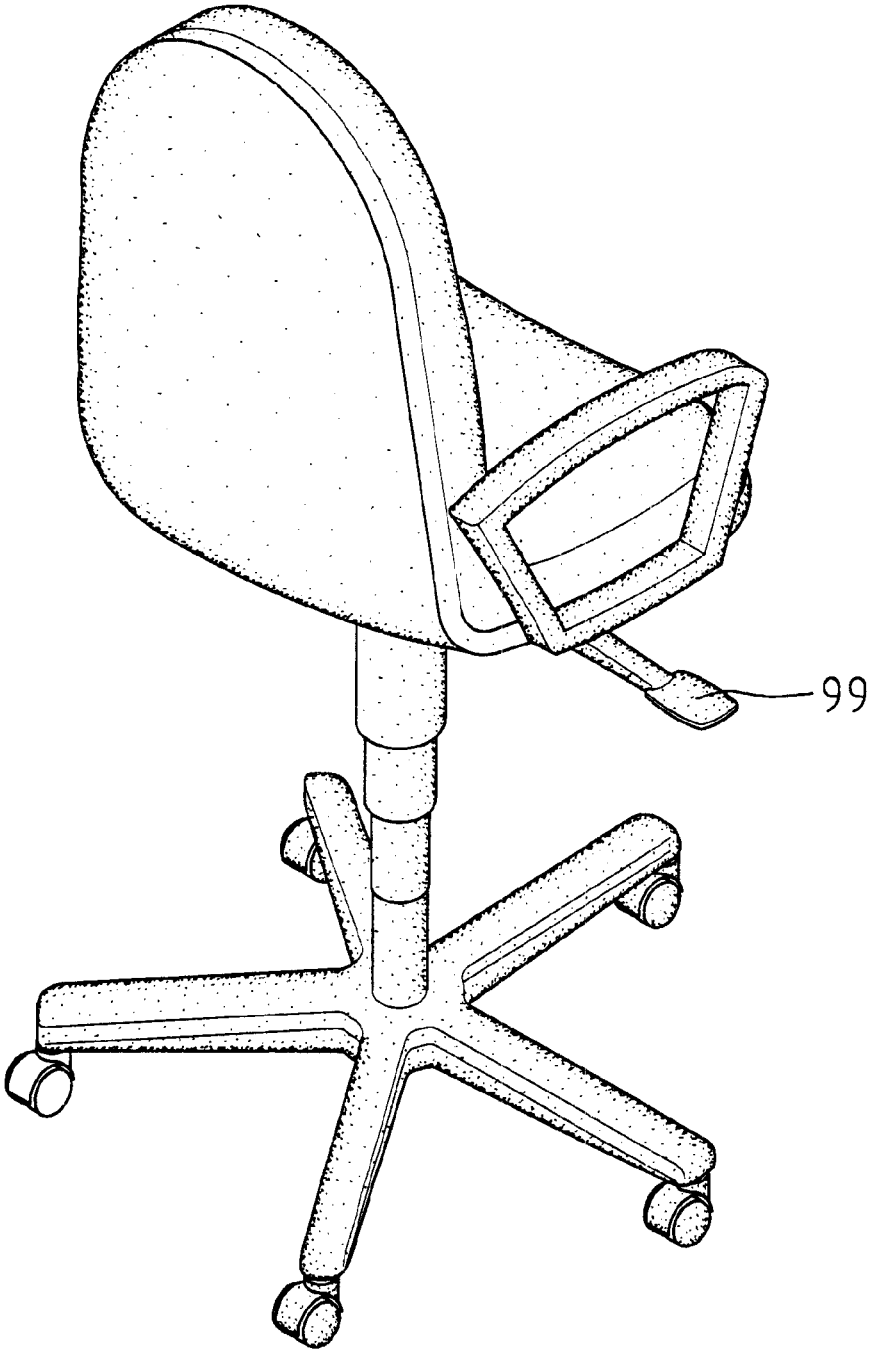
Fig. 6 PRIOR ART
FIG. 6 is a perspective view of a conventional chair equipped with a level-adjusting means.

As illustrated in FIG. 4, an actuating cable 90 includes a first end securely attached to the second arm 20*b* of the rocker 20 by a screw or bolt 251 and a second end that is connected to an upper end of a support rod 81 of the level-adjusting means 80 mounted to a frame 82 under the seat 92. It is noted that the actuating cable 90 passes through the through-hole 16 of the mounting seat 10 and the channel 26 of the rocker 20 with the first end being pressed against by the blot 251. When the user intends to adjust the level of the seat 92, the push button 40 is pushed to cause pivotal movement of the rocker 20. The actuating cable 90 becomes straight and thus moves the support rod 81 downward, as shown in FIG. 5. Next, gas (generally air) inside the level-adjusting means 80 pushes the support rod 81 upward such that the seat 92 is moved to its highest level. The user then lowers the seat by his/her own weight to release a portion of air in the level-adjusting means 80 until the required level is reached. The push button 40 returns to its initial position under the action of the spring 43 when the former is released. The opening 33 of the cover 30 allows pivotal movement of the second arm 20*b* of the rocker 20.

According to the above description, it is appreciated that the level of the seat 92 is adjustable without the need of a protruding operative rod that will adversely affect the overall aesthetically pleasing effect.

Although the invention has been explained in relation to its preferred embodiment, it is to be understood that many other possible modifications and variations can be made without departing from the scope of the invention as hereinafter claimed.

What is claimed is:

1. A chair comprising:

a seat;

a level-adjusting means mounted under the seat and including a support rod for supporting the seat;

an armrest attached to the seat, the armrest including a mounting seat securely attached to the seat, the mounting seat including an outer side having a compartment defined therein;

a rocker pivotally mounted to the armrest and including a first arm and a second arm, the rocker being fixed to a bottom wall defining the compartment;

a push button operably connected to the first arm of the rocker; and a cable having a first end fixed to the second arm of the rocker and a second end operably connected to the support rod, whereby the support rod is actuated when the push button is pushed, thereby controlling a level of the seat.

2. The chair as claimed in claim 1, wherein the mounting seat includes a mounting plate projecting from a side thereof for securely engaging with the seat.

3. The chair as claimed in claim 1, wherein the rocker comprises a central slot and a stub formed between two lateral sides defining the central slot, a fixing plate having a first end fixed to the bottom wall of the mounting seat, the fixing plate further having a hooked second end engaged with the stub.

4. The chair as claimed in claim 1, wherein the second arm of the rocker includes an engaging portion having a screw hole and a channel, the first end of the cable being extended through the channel, a bolt being extended through the screw hole and pressing against the first end of the cable, thereby securing the first end of the cable to the rocker.

5. The chair as claimed in claim 1, wherein the bottom wall includes two engaging members and the rocker includes two pegs respectively formed on two lateral sides thereof for pivotally engaging with the engaging members, respectively.

6. The chair as claimed in claim 5, further comprising a cover for covering the compartment of the mounting seat.

7. The chair as claimed in claim 6, wherein the cover includes a cylinder with a screw hole, the mounting seat including a stepped hole, a screw being extended through the stepped hole and the screw hole of the cylinder to thereby secure the cover to the mounting seat.

8. The chair as claimed in claim 7, wherein the cover includes an engaging plate, a peripheral wall defining the compartment of the mounting seat including an engaging groove for receiving the engaging plate.

9. The chair as claimed in claim 8, wherein the engaging plate of the cover includes a screw hole, a through-hole extending through the peripheral wall defining the compartment and a bottom wall defining the engaging groove, a further screw being extended through the through-hole and engaged with the screw hole of the engaging plate.

10. The chair as claimed in claim 9, wherein the rocker includes a protrusion, further comprising a torsion spring mounted around one of the pegs and having a first end attached to the protrusion and a second end attached to the bottom wall of the mounting seat for returning the rocker to its original position.

11. The chair as claimed in claim 9, further comprising an elastic element attached between the cover and the push button for returning the push button to its original position.

12. The chair as claimed in claim 9, wherein the cover includes a slot, the push button including an actuating piece that is extended through the slot of the cover and connected with the first arm of the rocker.

13. The chair as claimed in claim 12, wherein the cover includes two holes, the push button including two legs extending through the holes of the cover, respectively.

14. The chair as claimed in claim 13, wherein each said leg includes a hooked portion for preventing disengagement of the push button from the cover.

* * * * *